US011581684B2

(12) United States Patent
Wang et al.

(10) Patent No.: US 11,581,684 B2
(45) Date of Patent: Feb. 14, 2023

(54) HIGH FREQUENCY ELECTRICAL CONNECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Rui-Qin Wang, Kunshan (CN); Zhan-Sheng Meng, Kunshan (CN); Meng Liu, Kunshan (CN); Yen-Chih Chang, New Taipei (TW); Yu-San Hsiao, New Taipei (TW); Shih-Wei Hsiao, New Taipei (TW); Jhih-Yao Jiang, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 245 days.

(21) Appl. No.: 17/134,539

(22) Filed: Dec. 28, 2020

(65) Prior Publication Data

US 2021/0194180 A1 Jun. 24, 2021

(30) Foreign Application Priority Data

Dec. 24, 2019 (CN) ..... 201911346013.3

(51) Int. Cl.
*H01R 13/648* (2006.01)
*H01R 13/6461* (2011.01)
(Continued)

(52) U.S. Cl.
CPC ..... *H01R 13/6461* (2013.01); *H01R 13/112* (2013.01); *H01R 13/405* (2013.01)

(58) Field of Classification Search
CPC .. H01R 23/688; H01R 23/7068; H01R 12/57; H01R 23/725; H01R 9/0757
(Continued)

(56) References Cited

U.S. PATENT DOCUMENTS

| | | | | |
|---|---|---|---|---|
| 9,391,407 | B1 * | 7/2016 | Bucher | H01R 13/659 |
| 10,659,857 | B1 * | 5/2020 | Hu | H04R 1/025 |
| 11,101,611 | B2 * | 8/2021 | Winey | H01R 12/75 |

FOREIGN PATENT DOCUMENTS

| | | | |
|---|---|---|---|
| CN | 109659726 | A | 4/2019 |
| CN | 109830820 | A | 5/2019 |
| CN | 110459920 | A | 11/2019 |

* cited by examiner

*Primary Examiner* — Phuong Chi Thi Nguyen
(74) *Attorney, Agent, or Firm* — Ming Chieh Chang

(57) ABSTRACT

An electrical connector includes an elongate insulative housing defining a central slot extending along a longitudinal direction, and two rows of contacts disposed by two sides of the central slot. The housing forms a front receiving cavity to receive the corresponding mating tongue of the complementary connector, and a rear receiving cavity to receive the corresponding insulators wherein each insulator is integrally formed with each row of contacts via insert-molding for completing the whole contact module. Each grounding contact is equipped with the corresponding EMI absorber before being insert-molded within the insulator so as to have the corresponding EMI absorber also integrally formed with the insulator.

19 Claims, 17 Drawing Sheets

(51) Int. Cl.
*H01R 13/11* (2006.01)
*H01R 13/405* (2006.01)

(58) Field of Classification Search
USPC ..... 439/108
See application file for complete search history.

HIGH FREQUENCY ELECTRICAL CONNECTOR

BACKGROUND OF THE INVENTION

1. Field of the Invention

The present invention relates to an electrical connector, and particularly to the electrical connector equipped with the EMI (Electromagnetic Interference/RFI (Radio-Frequency Interference) absorber.

2. Description of Related Arts

As shown in US Patent Application Publication No. 2020/0036122, the electrical connector includes a body enclosing a plurality of terminals wherein the body (1) is made of a high-magnet conductive wave absorbing material to link all grounding contacts (22) while the signal modules (S) with the corresponding signal/differential pair contacts (23) insert-molded within the plastic blocks (3) are inserted into the corresponding installation holes (14). Even though such an arrangement may provide circumferential EMI shielding with regard to each differential pair contacts (23) for improving electrical performance advantageously, the required relatively more expensive material of the so-called high-magnet conductive wave absorbing and a relatively more complicated manufacturing process disadvantageously.

Therefore, an improvement to the electrical connector with the desired electrical performance of EMI/RFI shielding while using less relatively expensive EMI absorbing material in an economic way.

SUMMARY OF THE INVENTION

To achieve the above object, an electrical connector includes an elongate insulative housing defining a central slot extending along a longitudinal direction, and two rows of contacts disposed by two sides of the central slot. The housing forms a front receiving cavity to receive the corresponding mating tongue of the complementary connector, and a rear receiving cavity to receive the corresponding insulators wherein each insulator is integrally formed with each row of contacts via insert-molding for completing the whole contact module. Each grounding contact is equipped with the corresponding EMI absorber before being insert-molded within the insulator so as to have the corresponding EMI absorber also integrally formed with the insulator. Each contact includes a front resilient contacting section and a rear soldering section with a horizontal connecting section therebetween wherein the corresponding EMI absorber is attached upon the connecting section for lowering the resonance and the radiation of the corresponding grounding contact.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
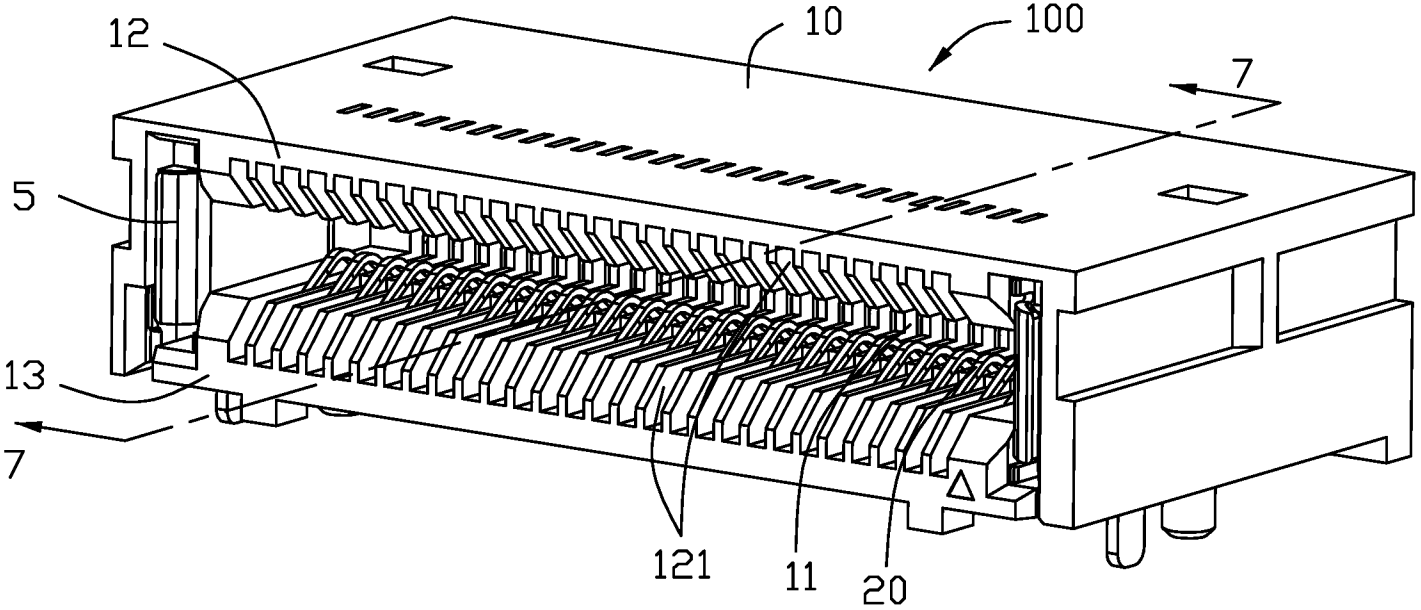
FIG. 1 is a perspective view of an electrical connector according to a first embodiment of the invention.
Figure 2:
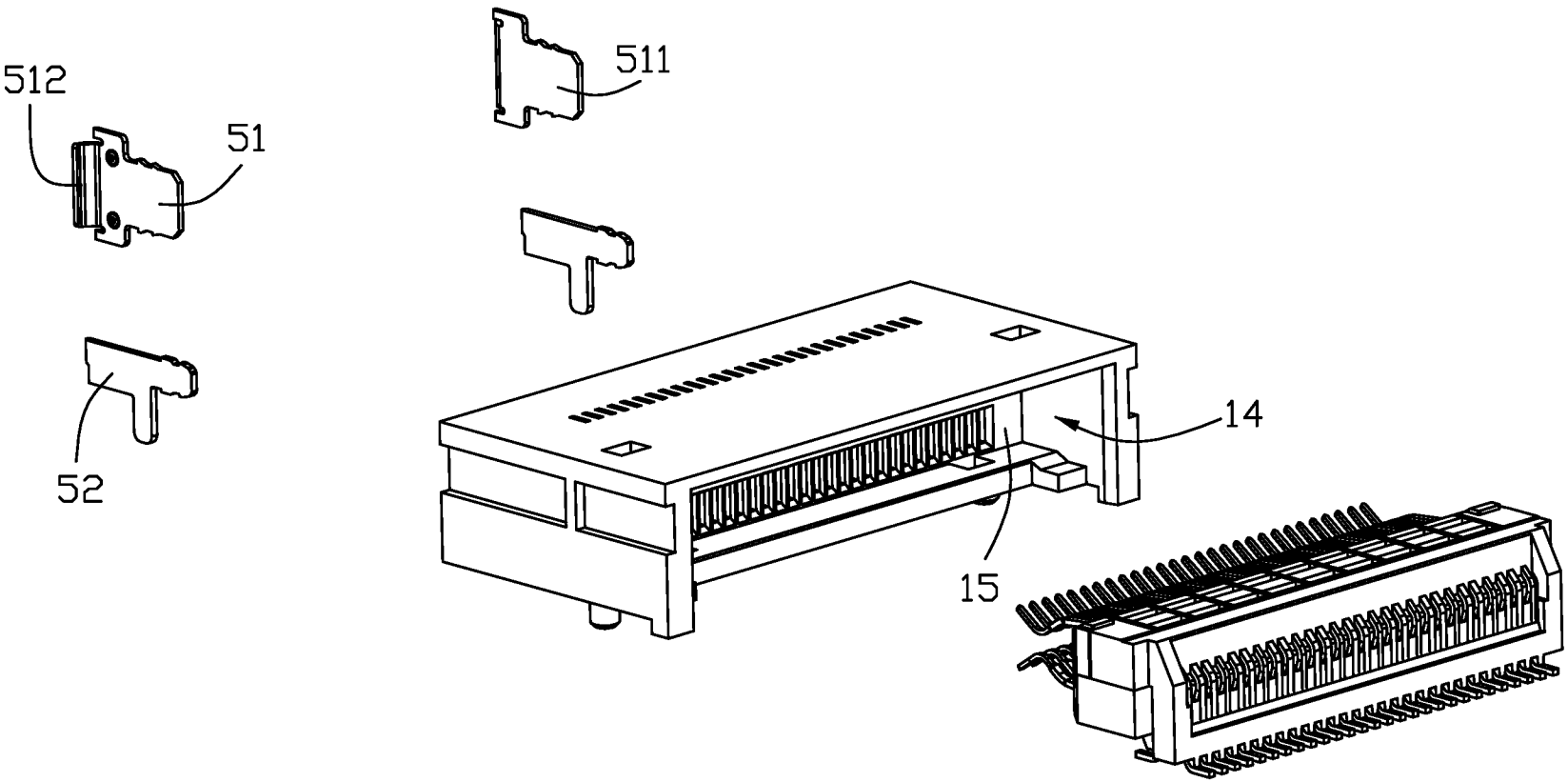
FIG. 2 is an exploded perspective view of the electrical connector of FIG. 1.
Figure 3:
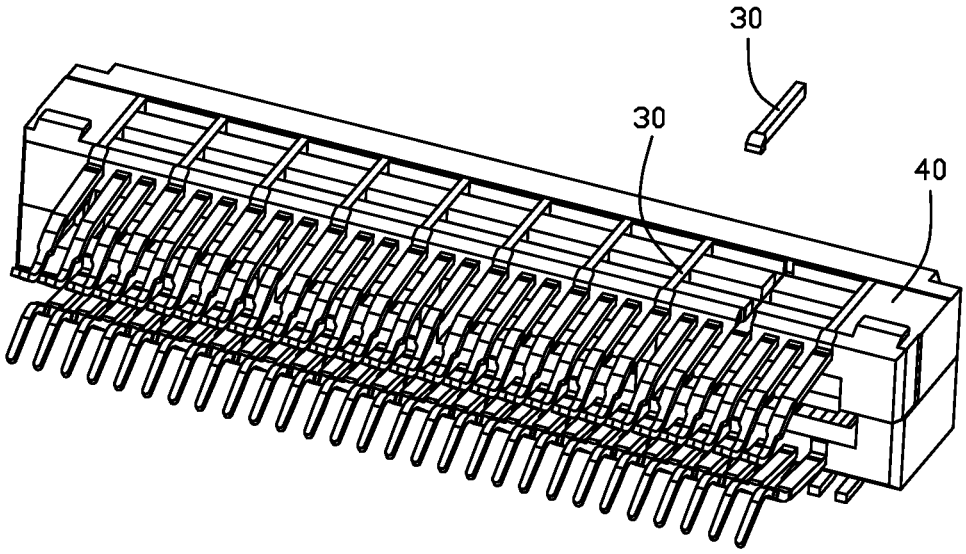
FIG. 3 is a perspective view of the contact module of the electrical connector of FIG. 1 wherein one EMI absorber is removed therefrom.
Figure 4:
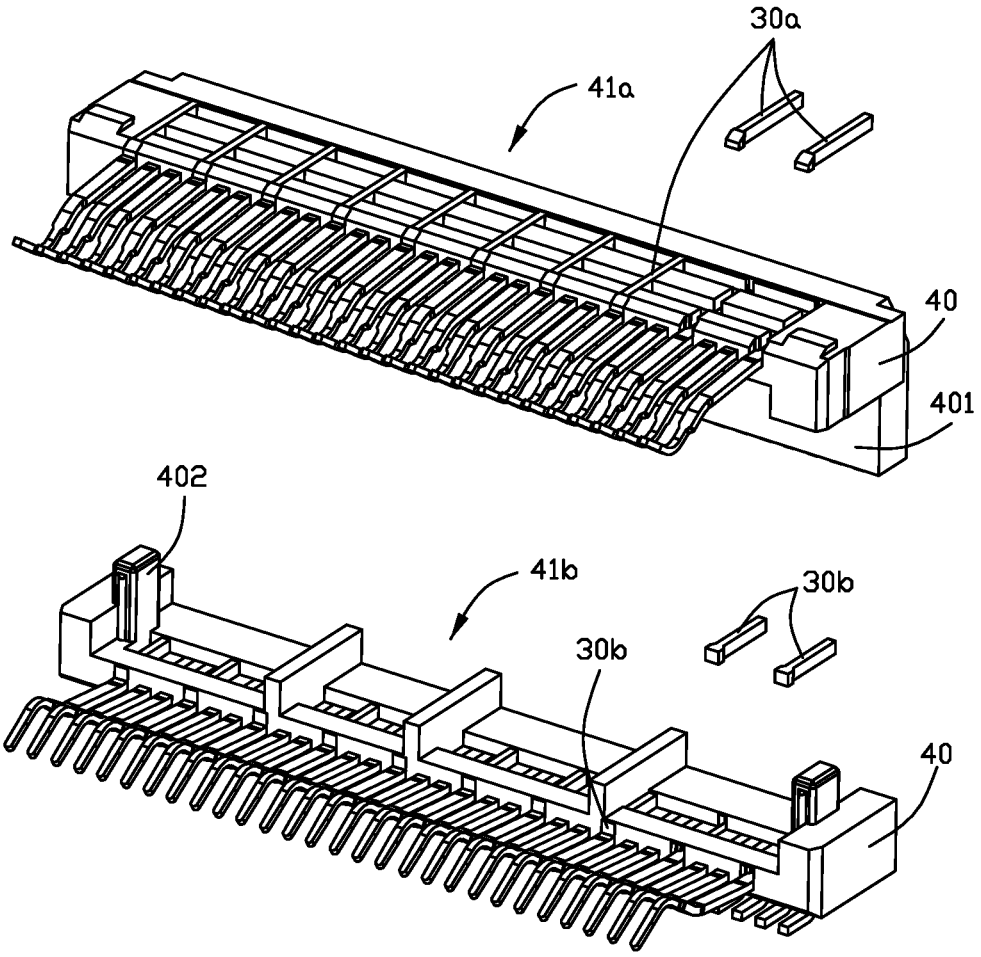
FIG. 4 is an exploded perspective view of the contact module of the electrical connector of FIG. 3.
Figure 5:
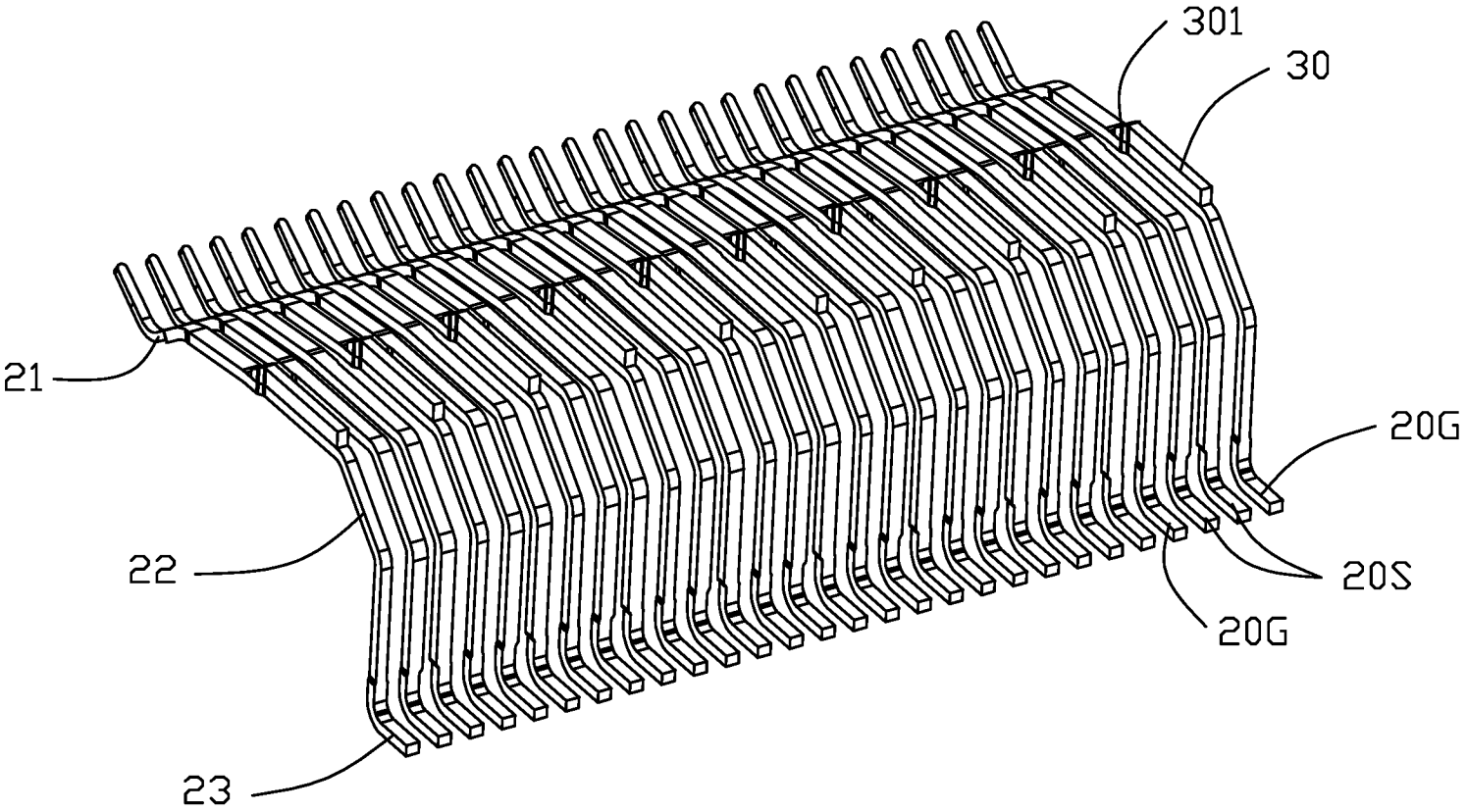
FIG. 5 is a perspective view of the upper row of contacts of the electrical connector of FIG. 1.
Figure 6:
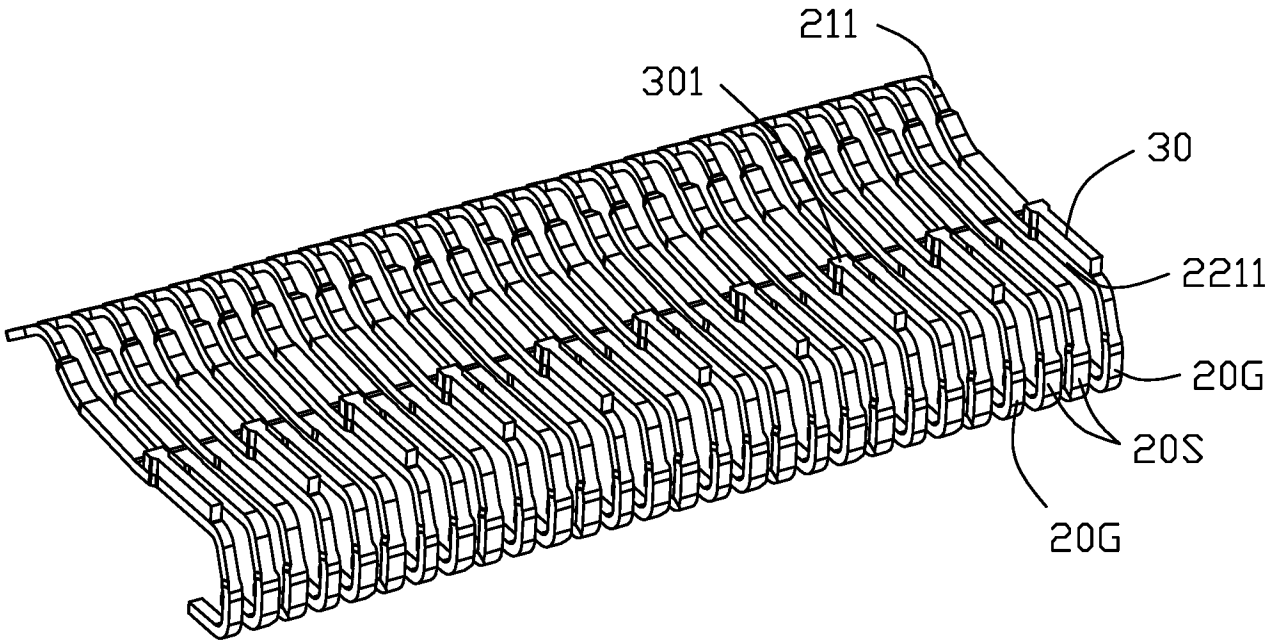
FIG. 6 is a perspective view of the lower row of contacts of the electrical connector of FIG. 1.
Figure 7:
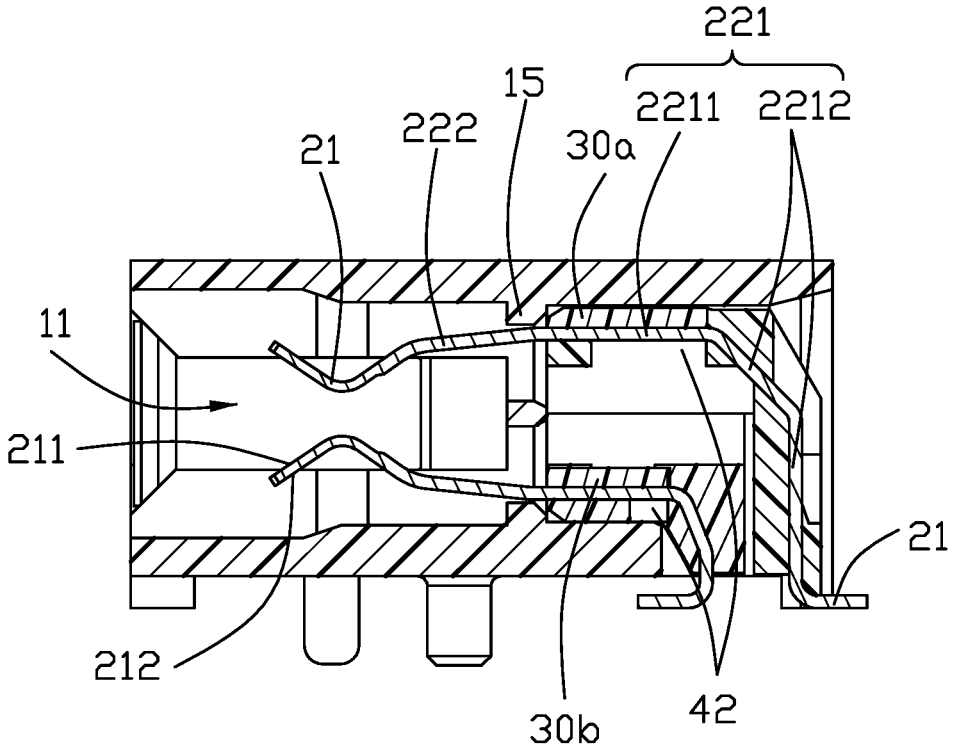
FIG. 7 is a cross-sectional view of the electrical connector of FIG. 1.

The invention is to lower the resonance during high frequency transmission by equipping the grounding contacts with the EMI absorbers, respectively.

Referring to FIGS. 1-7, an electrical connector 100 includes an insulative housing 10, a plurality of contacts 20 and the absorbers 30. The housing 10 includes a horizontal mating slot 11, i.e., the front receiving cavity, and opposite upper wall 12 and lower wall 13 by two sides with corresponding passageways 121. The contacts 2 include upper and lower contacts respectively located in the upper wall 12 and the lower wall 13, respectively. Each contact 20 includes a front resilient contacting section 21, the rear soldering section 23 and a middle connecting section 22 therebetween. The contacting section 21 is received within the corresponding passageway 121 and extends into the mating slot 11, and the soldering section 23 extends out of the housing for mounting to the printed circuit board (not shown). Each row of contacts 20 include the grounding contacts 20G and the differential-pair signal contacts 20S alternately arranged with each other along the longitudinal direction. The connecting section 22 of each grounding contact 20G is equipped with the EMI absorber 30 via adhesion. The EMI absorber 30 can be made by mixing the metal powder into the insulator or adding the absorbing material into the polymer so as to weaken the electromagnetic energy.

The absorber 30 is adhered to the connecting section 22 of the grounding contact 20G via insert-molding initially, and all the contacts 20 in the same row are integrally formed with the insulator 40 via another insert-molding successively to form the contact subunit. The contact module includes the upper contact subunit 41 and a lower contact subunit 42 stacked with each other and commonly received within the rear receiving cavity 14 of the housing 10. The front end of the insulator 40 abuts against the stopper 15 between the mating slot 11 and the rear receiving cavity 14.

The connecting section 22 includes a retaining section 221 embedded within the insulator 40, and an oblique section 222. The retaining section 221 includes a horizontal portion 2211 and a bending portion 2212. The oblique section 222 is located between the contacting section 21 and the horizontal portion 2211. The absorber 30 is secured to the horizontal portion 2211. The contact 20 defines opposite faces 211 and 212. Notably, the absorber 30 is attached to one of the opposite side surface 211, 212. In this embodiment, the absorber 30 is attached to the upper side of the horizontal portion 2211 of the upper contact 20, and the absorber 30 is attached to the upper side of the horizontal portion 2211 of the lower contact 20, too. Corresponding, the insulator 40 forms an opening 42 opposite to the absorber 30 for heat dissipation. Understandably, in an alternate manufacturing way the insulator 40 may be integrally formed with the contacts 20 to form the basic structure of the corresponding contact subunit, and the absorbers 30 are successively applied thereto, either by assembling the preformed one or molding the one from the melted material.

The absorber 30 includes an enlarged head 301 to enhance retention between the absorber 30 and the insulator 40. The insulator 40 of the upper contact subunit 41 includes a vertical wall 401, and the lower contact subunit 42 includes a pair of positioning posts 402 for assembling. A pair of reinforcement tabs 51 are located by two sides of the mating slot 11. Each reinforcement tab 51 faces toward the mating slot 11 in the longitudinal direction, and forms an outwardly obliquely extending guiding regions 512 at a front end. A pair of board locks 52 are located beside the corresponding reinforcement tabs 51, respectively.

Figure 8:
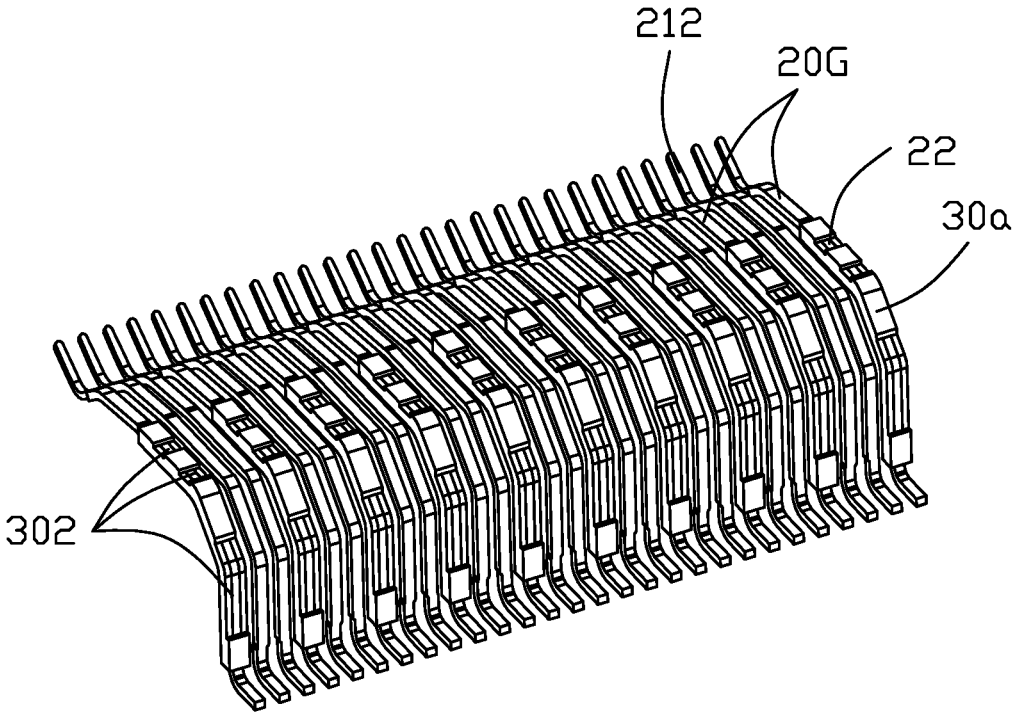
FIG. 8 is a perspective view of the upper row of contacts of the electrical connector according to a second embodiment of the invention.
Figure 9:
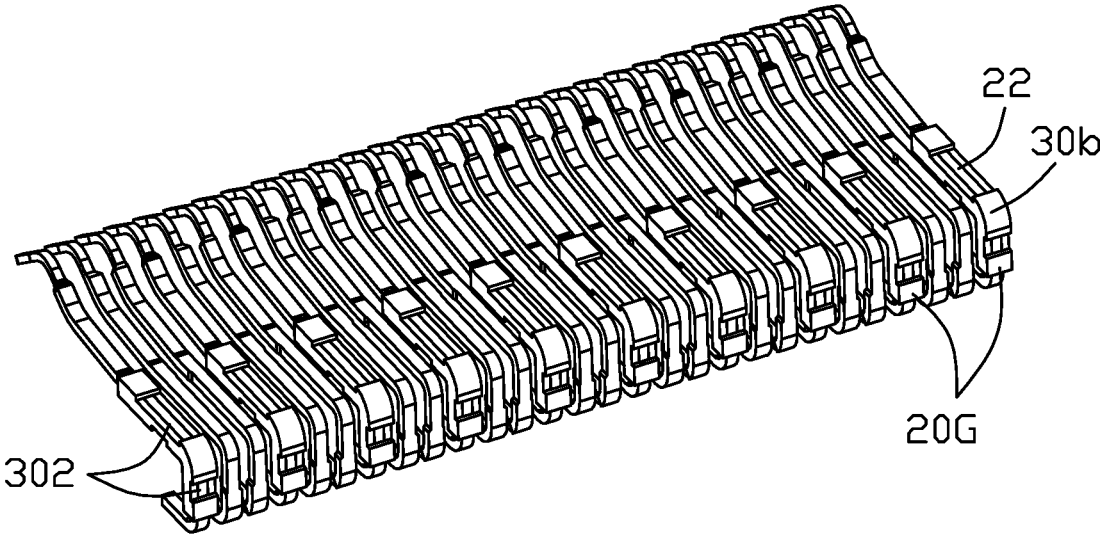
FIG. 9 is a perspective view of the lower row of contacts of the electrical connector of FIG. 8.
Figure 10:
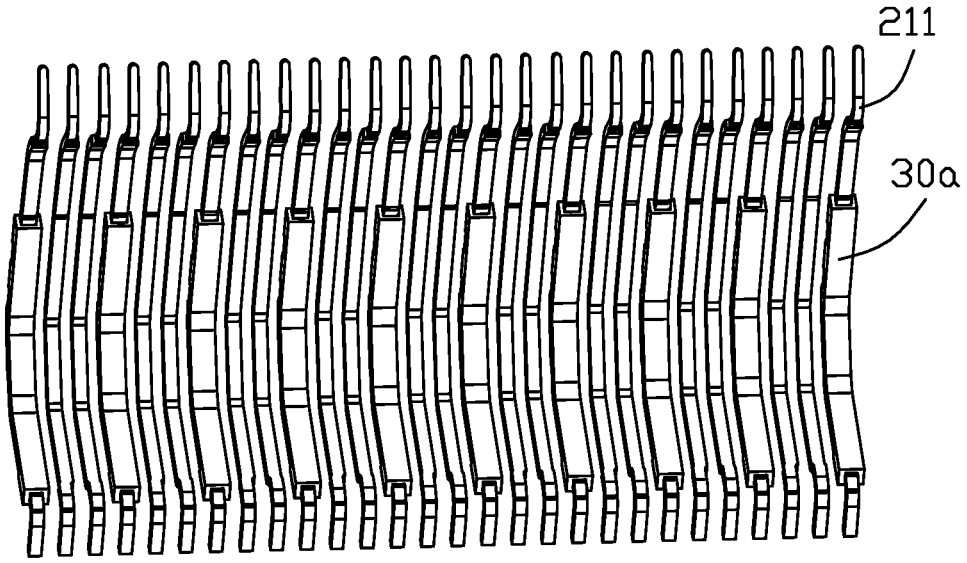
FIG. 10 is another perspective view of the upper row of contacts of the electrical connector of FIG. 8.
Figure 11:
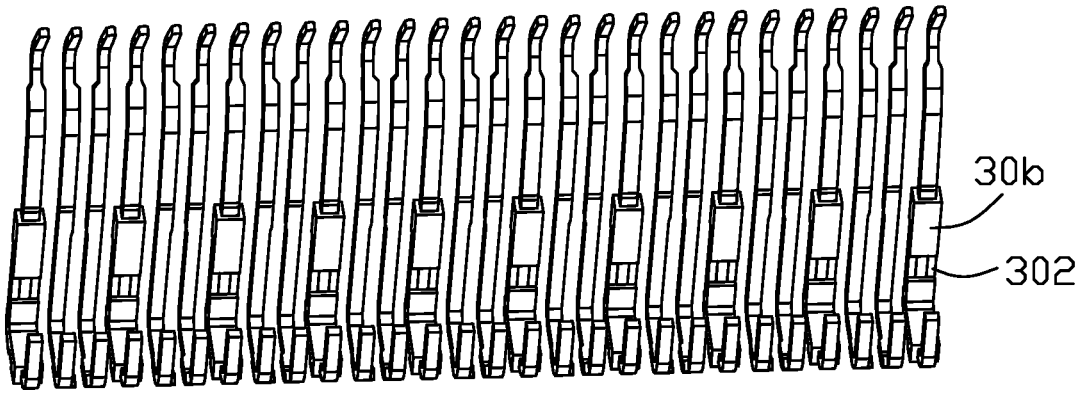
FIG. 11 is another perspective view of the lower row of contacts of the electrical connector of FIG. 9.
Figure 12:
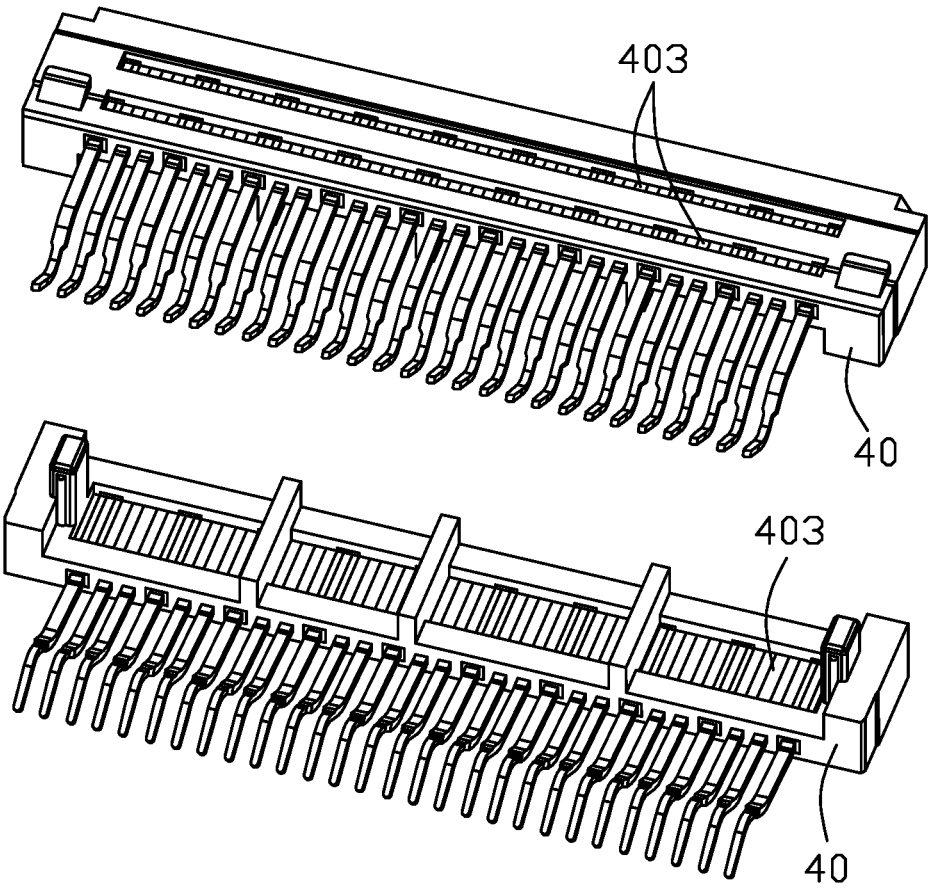
FIG. 12 is an exploded perspective view of the contact module of the electrical connector of FIG. 8.
Figure 13:
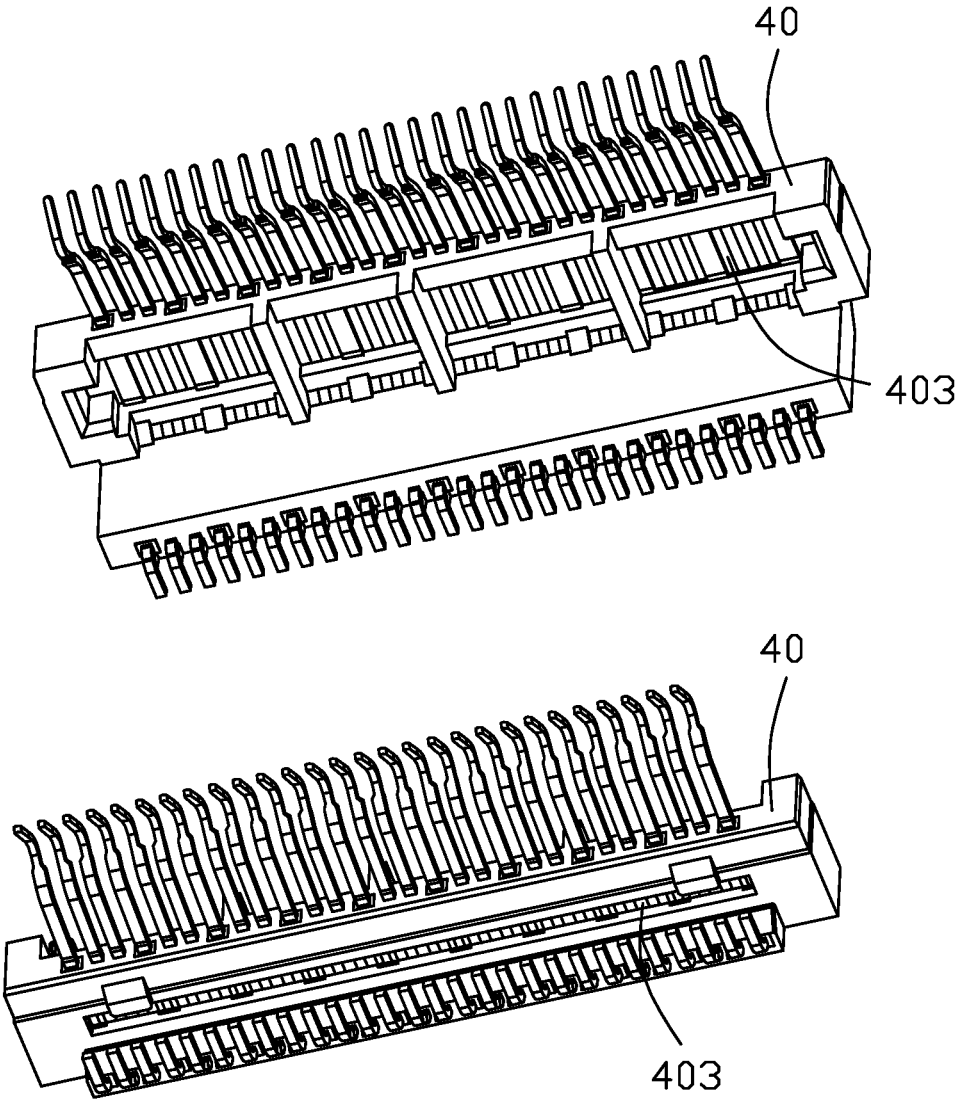
FIG. 13 is another exploded perspective view of the contact module of the electrical connector of FIG. 12.
Figure 14:
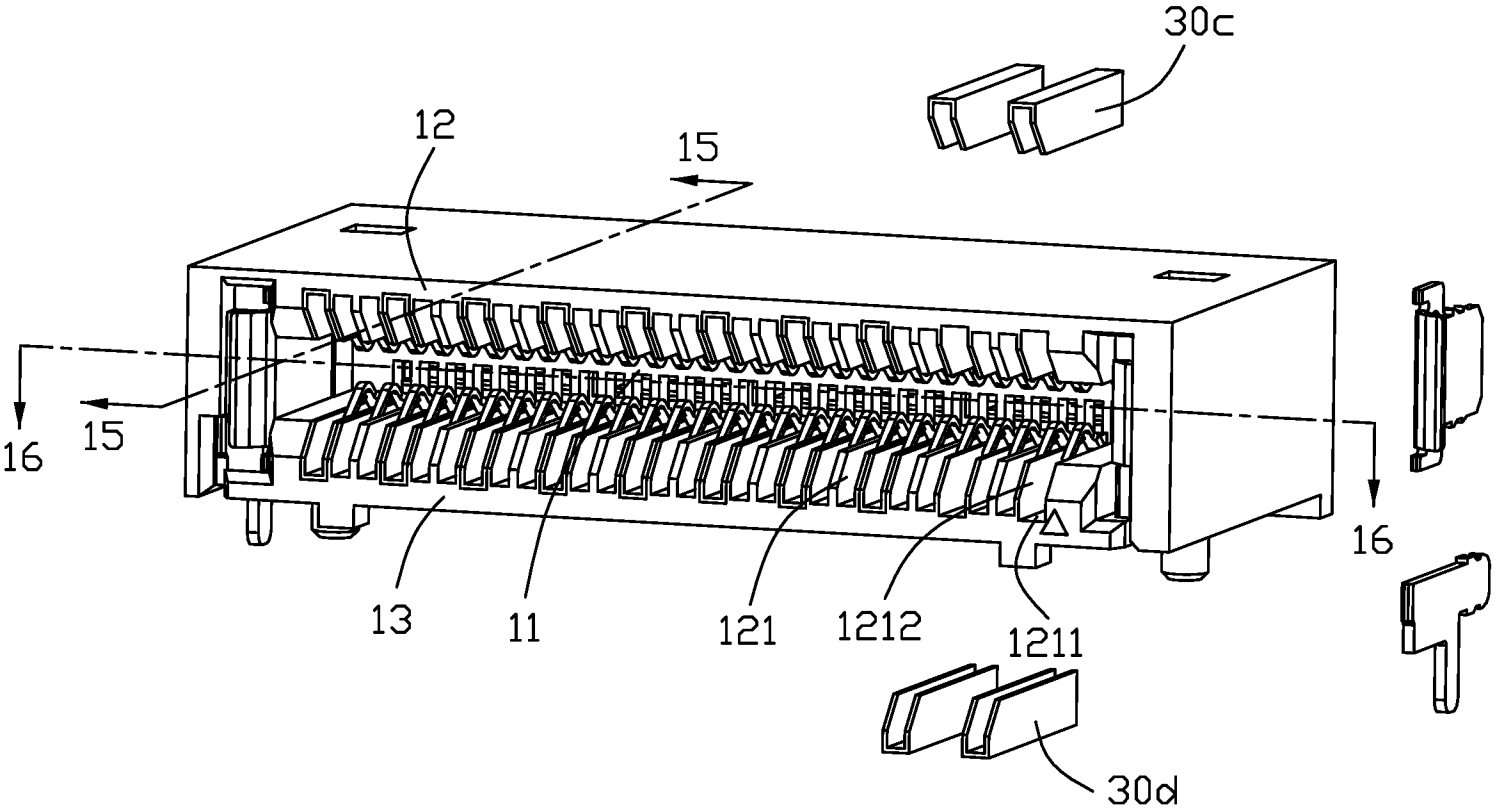
FIG. 14 is a perspective view of a third embodiment of the electrical connector.

Referring to FIGS. 8-13 illustrating the second embodiment, the housing and the contacts are essentially similar to those disclosed in the first embodiment. The primary difference between the first embodiment and the second embodiment is the configuration of the absorber upon the corresponding grounding contact wherein the absorber 30*a*, 30*b* circumferentially encloses the connecting section 22, i.e., the four sides, and extends forward to reach the front end of the insulator, and backward to reach the soldering section 23. Similar to those in the first embodiment, the absorber forms an opening 302 at some positions to expose the connecting section 22. In this embodiment, the absorber on the grounding contact in the upper row forms three openings 302 in an outer/upper face while forms no opening in an inner/lower face, as shown in FIG. 8. Differently, the absorber on the grounding contact in the lower row forms two openings 302 in an inner/upper face and also forms one opening in the outer/lower face, as shown in FIG. 9. Via these openings 302, the heat occurs around the connecting section 22 may be removed outwardly. Notably, as shown in FIGS. 12-13, the insulator 40 forms an elongated opening 403 through which the heat derived from the connecting section 22 and the absorber 30 can be outwardly dissipated.

Referring to FIGS. 14-17 illustrating the third embodiment, the housing and the contacts are essentially similar to those disclosed in the first embodiment. The main difference is the additional absorber disposed in the corresponding passageway 121, 131. In detail, the upper passageway 121 is defined by a horizontal part 1211 and a pair of side parts 1212. The corresponding absorber 30*c*, 30*d* having the corresponding U-shaped structure, is applied upon the horizontal part 1211 and the pair of side parts 1212. Therefore, as shown in this embodiment, the contacting section 21 and the oblique section 222 can be deemed to be surrounded by the absorber 30*c*, 30*d* with corresponding tiny gaps, compared with the connecting section 22 which is intimately surrounded by the absorber 30*a*, 30*b*.

Notably, only the grounding contacts are associated with the corresponding EMI absorber 30*a*, 30*b*, 30*c* and 30*d* while the differential-pair signal contacts are not.

Figure 15:
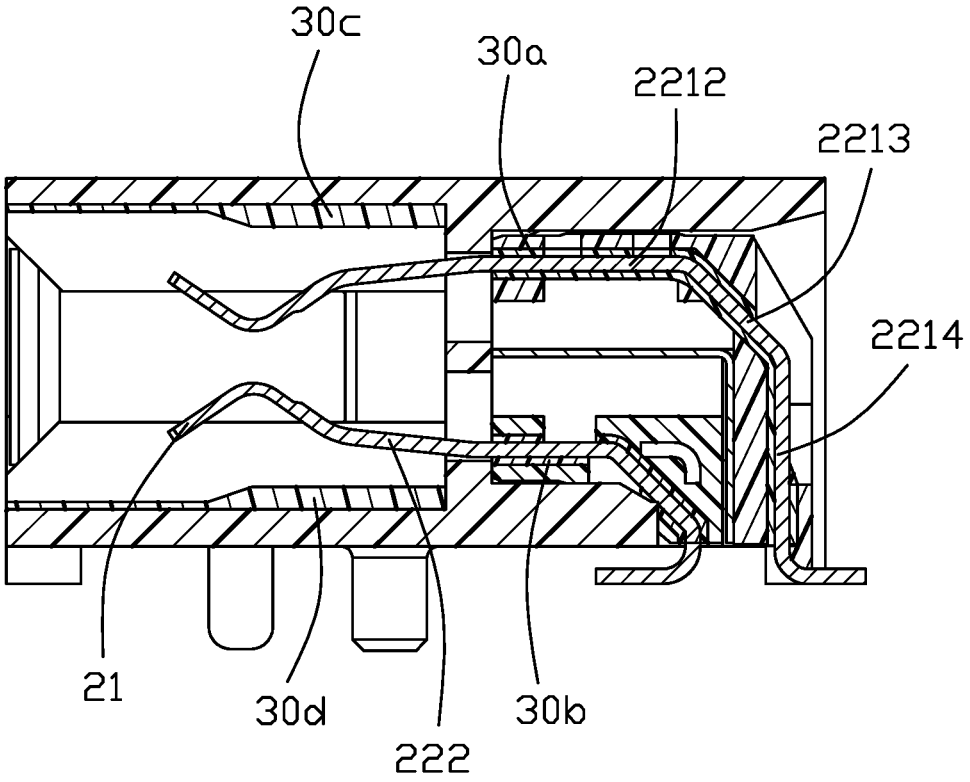
FIG. 15 is a cross-sectional view of the electrical connector of FIG. 14 along line 15-15.
Figure 16:
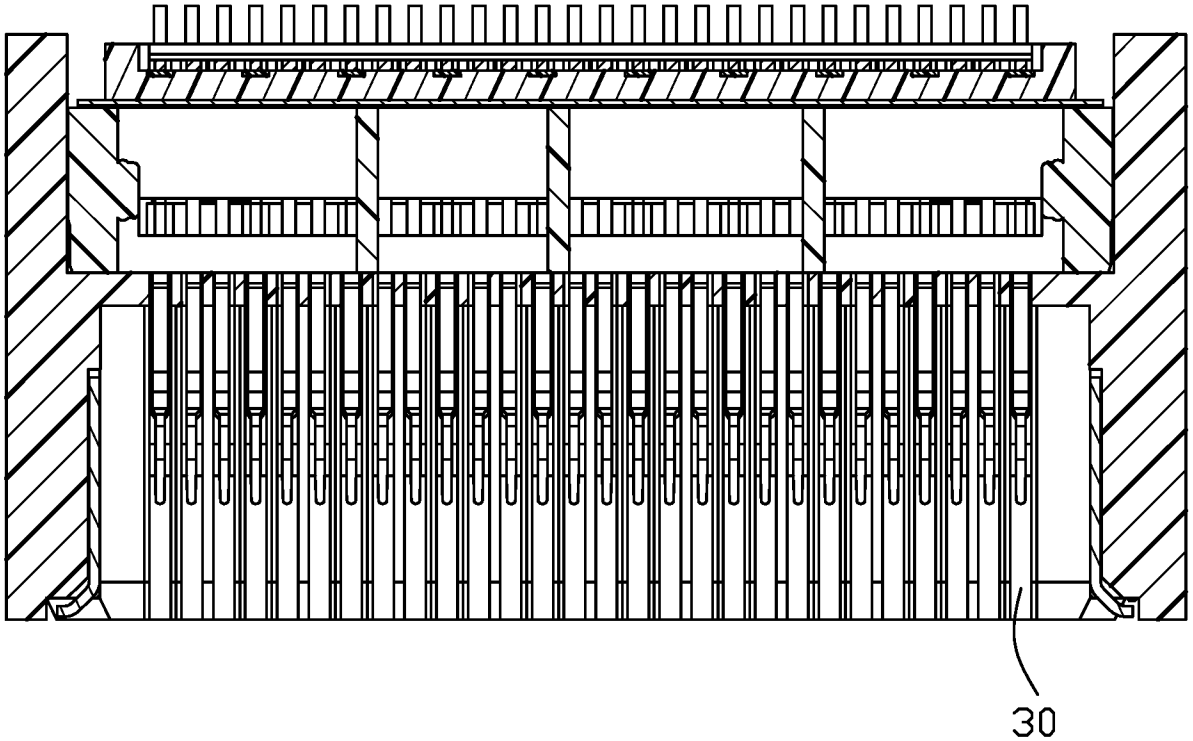
FIG. 16 is a cross-sectional view of the electrical connector of FIG. 14 along line 16-16.
Figure 17:
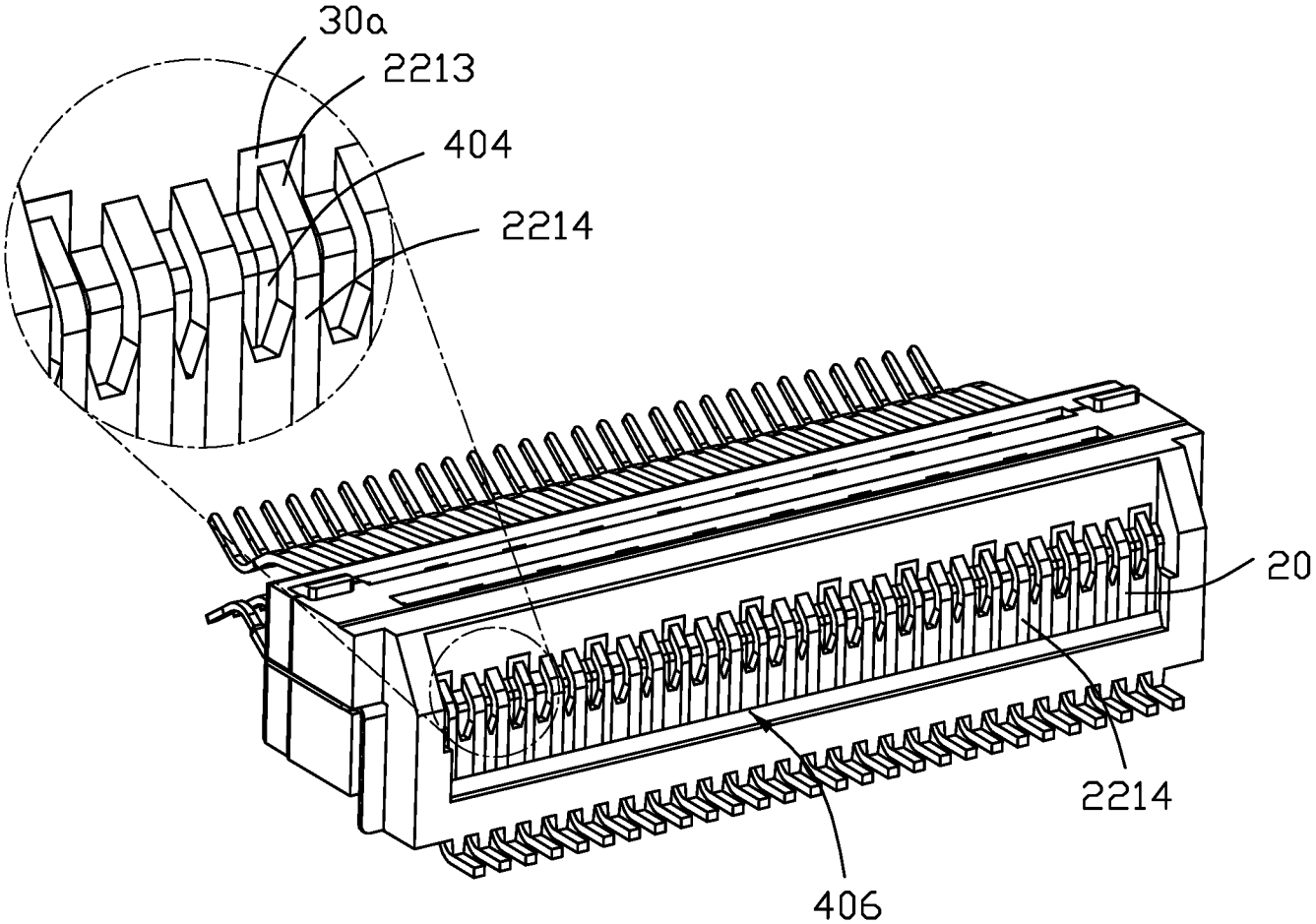
FIG. 17 is a perspective view of the electrical connector of FIG. 14 wherein a portion is enlarged for illustration.

As shown in FIG. 15, in the upper row of contacts 20 the corresponding retaining sections 221 includes the horizontal portion 2212, the vertical portion 2214 and the oblique portion 2213 therebetween wherein the vertical portion 2214 is embedded within the vertical wall 401 of the insulator 40. A recession 406 is formed in the vertical wall 401 to expose the vertical portion 2214 as well as the oblique portion 2213. Another recess 204 which is recessed from the recession 406, is formed in the insulator 40 around the oblique portion 2213. Understandably, the recess and the recession are used for heat dissipation.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing defining a mating slot extending in a longitudinal direction, and a receiving cavity located behind the mating slot;

a contact module disposed in the housing and including at least one row of contacts integrally formed, via an insert-molding process, within an insulator which is received within the receiving cavity, the contacts including a plurality of grounding contacts and a plurality of differential-pair signal contacts alternately arranged with each other along the longitudinal direction, each contact including a resilient front contacting section, a rear soldering section and a middle connecting section therebetween; wherein each grounding contact is intimately equipped with an EMI (Electromagnetic Interference) absorber around the connecting section before the insert-molding process, and the EMI absorber is adhered to the insulator via the insert-molding process.

2. The electrical connector as claimed in claim 1, wherein the absorber is attached to the contact via insert-molding.

3. The electrical connector as claimed in claim 1, wherein each contact is stamped from sheet metal and includes two opposite surfaces, and the EMI absorber is attached upon only one surface of the corresponding contact.

4. The electrical connector as claimed in claim 2, wherein the insulator forms an opening to expose the contact which is enclosed by the EMI absorber.

5. The electrical connector as claimed in claim 1, wherein the housing forms a plurality of passageways beside the mating slot in a vertical direction perpendicular to the longitudinal direction to receive the contacting sections of the contacts, respectively, and each passageway is equipped with another EMI absorber to surround the contacting section of the corresponding contact.

6. The electrical connector as claimed in claim 5, wherein the EMI absorber in the passageway defines a U-shaped structure.

7. The electrical connector as claimed in claim 1, wherein each contact is stamped from sheet metal and includes two opposite surfaces, and the EMI absorber circumferentially encloses the contact.

8. The electrical connector as claimed in claim 7, wherein the EMI absorber forms an opening to expose the corresponding contact.

9. The electrical connector as claimed in claim 7, wherein the EMI absorber is enclosed within the insulator.

10. The electrical connector as claimed in claim 9, wherein the insulator forms an opening to expose the absorber.

11. The electrical connector as claimed in claim 9, wherein the insulator forms an opening to expose the contact which is enclosed by the EMI absorber.

12. An electrical connector comprising:

an insulative housing defining a mating slot extending in a longitudinal direction, and a receiving cavity located behind the mating slot;

a contact module disposed in the housing and including at least one row of contacts integrally formed, via an insert-molding process, within an insulator which is received within the receiving cavity, the contacts including a plurality of grounding contacts and a plurality of differential-pair signal contacts alternately arranged with each other along the longitudinal direction, each contact including a resilient front contacting section, a rear soldering section and a middle connecting section therebetween; wherein the housing forms a plurality of passageways beside the mating slot in a vertical direction perpendicular to the longitudinal direction to receive the contacting sections of the contacts, respectively, and each passageway is equipped with an EMI absorber to surround the contacting section of the corresponding contact with a gap.

13. The electrical connector as claimed in claim 12, wherein the EMI absorber in the passageway defines a U-shaped structure.

14. The electrical connector as claimed in claim 12, wherein the connecting section of each grounding contact is intimately adhered with another EMI absorber which is further adhered with the insulator.

15. The electrical connector as claimed in claim 14, wherein said another EMI absorber encloses the connecting section of the grounding contact circumferentially.

16. The electrical connector as claimed in claim 15, wherein said another EMI absorber forms opening to expose the connecting section of the grounding contact.

17. The electrical connector as claimed in claim 16, wherein the insulator forms an opening to expose said another EMI absorber.

18. The electrical connector as claimed in claim 17, wherein the opening of said another EMI absorber is at least partially aligned with the opening of the insulator in the vertical direction.

19. The electrical connector as claimed in claim 18, wherein the opening of the insulator extends in the longitudinal direction to cross the connecting sections of all the contacts.

* * * * *